US005394216A

United States Patent [19]

Suzuki et al.

[11] Patent Number: 5,394,216

[45] Date of Patent: Feb. 28, 1995

[54] AUTOMATIC PROCESSING APPARATUS

[75] Inventors: Motoi Suzuki; Yuji Inoue, both of Kanagawa, Japan

[73] Assignee: Fuji Photo Film Co., Ltd., Kanagawa, Japan

[21] Appl. No.: 40,971

[22] Filed: Mar. 31, 1993

[30] Foreign Application Priority Data

Apr. 3, 1992 [JP] Japan ..... 4-082097

[51] Int. Cl.[6] ..... G03D 3/02

[52] U.S. Cl. ..... 354/324; 354/325

[58] Field of Search ..... 354/318-324, 354/325, 331, 336; 134/64 P, 122 P

[56] References Cited

U.S. PATENT DOCUMENTS

| | | | |
|---|---|---|---|
| 4,034,389 | 7/1977 | Huss | 354/322 |
| 4,148,576 | 4/1979 | Martino | 354/320 |
| 4,314,753 | 2/1982 | Kaufmann | 354/298 X |
| 4,839,683 | 6/1989 | Kushima et al. | 354/322 |
| 4,972,219 | 11/1990 | Yamada | 354/322 |
| 5,272,499 | 12/1993 | Yamada | 354/319 |

FOREIGN PATENT DOCUMENTS

| | | |
|---|---|---|
| 501273 | 9/1992 | European Pat. Off. . |
| 3320787 | 12/1984 | Germany . |
| 2007540 | 5/1979 | United Kingdom . |

*Primary Examiner*—D. Rutledge

*Attorney, Agent, or Firm*—Sughrue, Mion, Zinn, Macpeak & Seas

[57] ABSTRACT

An automatic processing apparatus is provided to sequentially dip photosensitive material into a plurality of processing solution tanks storing processing solution while conveying the photosensitive material to process the photosensitive material. Rollers are respectively provided between two adjacent tanks of the plurality of processing solution tanks so as to convey the photosensitive material to a downstream processing solution tank of the two adjacent tanks. A replenishing solution supply apparatus is provided to supply replenishing solution into the plurality of processing solution tanks, respectively. A diluting water supply apparatus is provided in the vicinity of rollers to respectively supply the plurality of processing solution tanks with diluting water for diluting the replenishing solution to a predetermined concentration. The rollers can be washed by the diluting water to be supplied to each of the plurality of processing solution tanks.

21 Claims, 6 Drawing Sheets

AUTOMATIC PROCESSING APPARATUS

BACKGROUND OF THE INVENTION

1. Field of the Invention

The present invention relates to an automatic processing apparatus which processes photosensitive material for processing by sequentially conveying and dipping the material into a plurality of processing solution tanks accommodating processing solutions.

2. Description of the Related Art

An automatic processing apparatus for processing photosensitive material is provided with a developing tank, a fixing tank, a washing tank and the like. Processing solutions in the respective processing tanks are typically degraded according to the amount of processing of photosensitive material. In order to compensate for the degradation, replenishing stocks of the processing solution and diluting water are respectively supplied to the processing tanks through discrete conduits. The respective tanks include processing racks which hold a plurality of rollers for guiding the photosensitive material into the tanks. Further, over the tanks there are crossover racks which hold a roller for guiding the photosensitive material from one tank to the next tank. Rollers for conveying the photosensitive material, and a guide plate are attached to the processing racks and the crossover racks. Hence, the photosensitive material inserted into the automatic processing apparatus is conveyed and guided by the rollers of the processing rack into the respective tanks such as a developing tank in a substantially U-shaped form. Subsequently, the photosensitive material is delivered to the next tank by the rollers of the crossover rack. The rollers of the crossover rack are provided to squeeze off any processing solution which remains on the photosensitive material before the material is introduced into the next tank so as to prevent the processing solution from being brought into the next tank. In this case, the processing solution drawn by the photosensitive material may continue to adhere to rollers disposed in a vicinity of a liquid level of the processing solution, and rollers disposed over the liquid level. In particular, the processing solution may continue to adhere to the rollers disposed in the crossover rack and those disposed in a vicinity of partition walls which partition one processing tank from another. As a result, after the processing solution dries, deposits of contaminants may form on the roller. These deposits cause several problems. For example, they adversely effect the finish of the photosensitive material, or the driving of the processing apparatus. Therefore, it is necessary to wash the rollers disposed in the vicinity of the liquid level, and those disposed over the liquid level.

Hence, the rollers are washed by disposing one of a pair of squeezing rollers in the crossover rack so as to be immersed into a rinse tank, or by spraying washing water onto the squeezing rollers by an amount corresponding to an evaporated amount of processing solution. In the latter case, the water corresponding to the evaporated amount is not directly fed into the processing tank. Instead, the rollers convey after being sprayed with water. Accordingly, the rollers are washed by clean water thereby removing the contaminates and the deposits. Thereafter, the water is guided into the processing tank which replenishes water, and can serve as a supply of water corresponding to the evaporation.

However, while the amount of water corresponding to evaporation is affected by environmental conditions, the amount of influence is generally not so much. In addition, the amount of water is often not sufficient to remove the contaminates on the rollers. Further, if a supply of the diluting water is adjusted according to evaporation, the washing water for the rollers is guided into the processing tank by the amount corresponding to that evaporated even when the evaporation is large. Consequently, the concentration of the processing solution is diluted, and the water after washing must be directly recovered as waste fluid.

SUMMARY OF THE INVENTION

In view of the facts set forth hereinbefore, it is an object of the present invention to provide an automatic processing apparatus that ensures the washing of rollers without the need of special water supply means.

According to the first aspect of the present invention, there is provided an automatic processing apparatus for processing photosensitive material by sequentially conveying and immersing the photosensitive material into a plurality of processing solution tanks which store processing solution. The automatic processing apparatus includes a roller unit provided between two adjacent tanks of the plurality of processing solution tanks for conveying the photosensitive material to a downstream processing solution tank of the two adjacent tanks, replenishing solution supply means for supplying replenishing solution into an upstream processing solution tank of two adjacent tanks on the upstream side of the plurality of processing solution tanks, and diluting water supply means provided in the vicinity of the roller unit, for supplying diluting water into the upstream processing solution tank for being mixed with the replenishing solution so as to dilute the replenishing solution to a predetermined concentration. The roller unit is washed by the diluting water to be supplied to the upstream processing solution tank.

According to the second aspect of the present invention, there is provided an automatic processing apparatus for processing photosensitive material by sequentially conveying and immersing the photosensitive material into a plurality of processing solution tanks which stores processing solution. The automatic processing apparatus includes a roller unit provided between two adjacent tanks of the plurality of processing solution tanks, for conveying the photosensitive material to a downstream processing solution tank of the two adjacent tanks, replenishing solution supply means for supplying replenishing solution into an upstream processing solution tank of two adjacent tanks of the plurality of processing solution tanks, and diluting water supply means provided in the vicinity of the roller unit, having a spray pipe for ejecting diluting water, which is mixed with the replenishing solution to dilute the replenishing solution to a predetermined concentration, toward the roller unit so as to wash the roller unit, and supplying the upstream processing solution tank receiving a supply of the replenishing solution with the diluting water through the roller unit.

According to the third aspect of the present invention, there is provided an automatic processing apparatus for processing photosensitive material by sequentially conveying and immersing the photosensitive material into a plurality of processing solution tanks which store processing solution. The automatic processing apparatus includes a roller unit provided between two adjacent tanks of the plurality of processing solution tanks for conveying the photosensitive material to a downstream processing solution tank of the two adjacent tanks, replenishing solution supply means having a replenishing solution supply pipe for guiding and supplying replenishing solution into an upstream processing solution tank of two adjacent tanks of the plurality of processing solution tanks, and a trough into which the roller unit is partially immersed, for storing diluting water by receiving from diluting water supply means a supply of diluting water which is mixed with the replenishing solution to dilute the replenishing solution to a predetermined concentration. The diluting water stored in the trough is drawn from the trough by the rotation of the roller unit so as to wash the roller unit, and the diluting water after washing is guided into the upstream processing solution tank receiving a supply of the replenishing solution.

According to the fourth aspect of the present invention, there is provided an automatic processing apparatus for processing photosensitive material by sequentially conveying and immersing the photosensitive material into a plurality of processing solution tanks which store processing solution. The automatic processing apparatus includes a roller unit provided between two adjacent tanks of the plurality of processing solution tanks, for conveying the photosensitive material to a downstream processing solution tank of the two adjacent tanks, replenishing solution supply means for supplying replenishing solution into an upstream processing solution tank of two adjacent tanks of the plurality of processing solution tanks, diluting water supply means provided in the vicinity of the roller unit, having a spray pipe for ejecting diluting water, which is mixed with the replenishing solution to dilute the replenishing solution to a predetermined concentration, toward the roller unit so as to wash the roller unit, and supplying the upstream processing solution tank receiving a supply of the replenishing solution with the diluting water through the roller unit, and a trough into which the roller unit is partially immersed, for storing the diluting water by receiving the diluting water ejected by a diluting water ejecting spray pipe through the roller unit. Excessive diluting water is overflowed from the trough into the upstream processing solution tank.

According to the fifth aspect of the present invention, there is provided an automatic processing apparatus for processing photosensitive material by sequentially conveying and immersing the photosensitive material into a plurality of processing solution tanks which store processing solution. The automatic processing apparatus includes a roller unit provided between two adjacent tanks of the plurality of processing solution tanks, for conveying the photosensitive material to a downstream processing solution tank of the two adjacent tanks, replenishing solution supply means for supplying replenishing solution into an upstream processing solution tank of two adjacent tanks of the plurality of processing solution tanks, diluting water supply means provided in the vicinity of roller unit, having a spray pipe for ejecting diluting water which is mixed with the replenishing solution to dilute the replenishing solution to a predetermined concentration, toward the roller unit so as to wash the roller unit, and supplying the upstream processing solution tank receiving a supply of the replenishing solution with the diluting water through the roller unit, and a squeezing member disposed so as to contact a part of the roller unit, for squeezing off the diluting water adhering to the roller unit.

In an automatic processing apparatus according to the sixth aspect of the present invention, replenishing solution is supplied by an amount calculated based upon an area of the photosensitive material to be processed through replenishing solution supply means or the replenishing solution supply pipe during or immediately after processing of the photosensitive material.

According to the first aspect of the present invention, when producing appropriate replenisher by mixing the diluting water with the replenishing solution to dilute the replenishing solution, the diluting water which is not yet mixed with the replenisher is supplied to the roller unit for conveying the photosensitive material to the downstream processing solution tank between two adjacent tanks of the plurality of processing solution tanks, so as to wash the roller. As a result, no crystal or no contaminates adhere to the roller unit due to the processing solution, thereby avoiding damage to the photosensitive material. The diluting water is guided into the upstream processing tank after washing the roller so that the diluting water can be mixed with the replenishing solution so as to produce the replenisher in the upstream processing tank.

That is, it is possible to reduce an amount of water used for only washing the roller by using the diluting water as the washing water for the roller unit. Further, the diluting water supply means also serves as water supply means for washing the roller unit so that a special water supply means for washing the roller unit is not required, resulting in the simplification of the automatic processing apparatus.

According to the second aspect of the present invention, the spray pipe ejects the diluting water in the direction of the roller unit by an amount corresponding to the replenishing solution supplied according to an processing amount during or immediately after processing of the photosensitive material. Therefore, it is possible to enhance the washing effect of the roller unit, and reliably remove the contaminates by a small discharge quantity (i.e., an amount required for replenishment) of the diluting water.

Further, according to the third aspect of the present invention, the roller unit is partially immersed into the diluting water stored in the trough so that the roller unit can be continuously kept in a wet state, thereby preventing the roller unit from becoming dried. The prevention of drying prevents deposits or contaminates of constituents contained in the processing solution adhering to the roller unit from caking.

At a time of replenishment, clean diluting water is supplied to the trough by an amount corresponding to the replenishing solution supplied according to the processing amount during or immediately after the processing of the photosensitive material. Consequently, the diluting water overflows from the trough, and is guided into the upstream processing solution tank so as to be mixed with the replenishing solution.

According to the fourth aspect of the present invention, the spray pipe ejects the diluting water to wash the roller unit, and the ejected diluting water was once stored in the trough. The roller unit is partially immersed into the diluting water in the trough so that the roller unit is continuously kept in a wet state, and drying of the roller unit can be avoided.

Further, according to the fifth aspect of the present invention, the squeezing member is disposed so as to contact a part of the roller unit. Hence, the processing solution drawn from the upstream processing solution tank can be wiped off at a contact point between the roller unit and the squeezing member. That is, it is possible to reduce the amount of processing solution adhering to the roller. As a result, the processing solution is not drawn by the photosensitive material into the downstream tank, and contamination in the downstream tank can be avoided.

According to the sixth aspect of the present invention, the replenishing solution is supplied to the upstream processing tank according to an amount calculated based upon an area of the photosensitive material to be processed during or immediately after the processing. As a result, there is no variation in sensitivity of the processing solution.

As set forth hereinbefore, in the automatic processing apparatus of the present invention, there is an excellent effect in that the roller unit can be reliably washed without special water supply means.

DESCRIPTION OF THE PREFERRED EMBODIMENT

Figure 1:
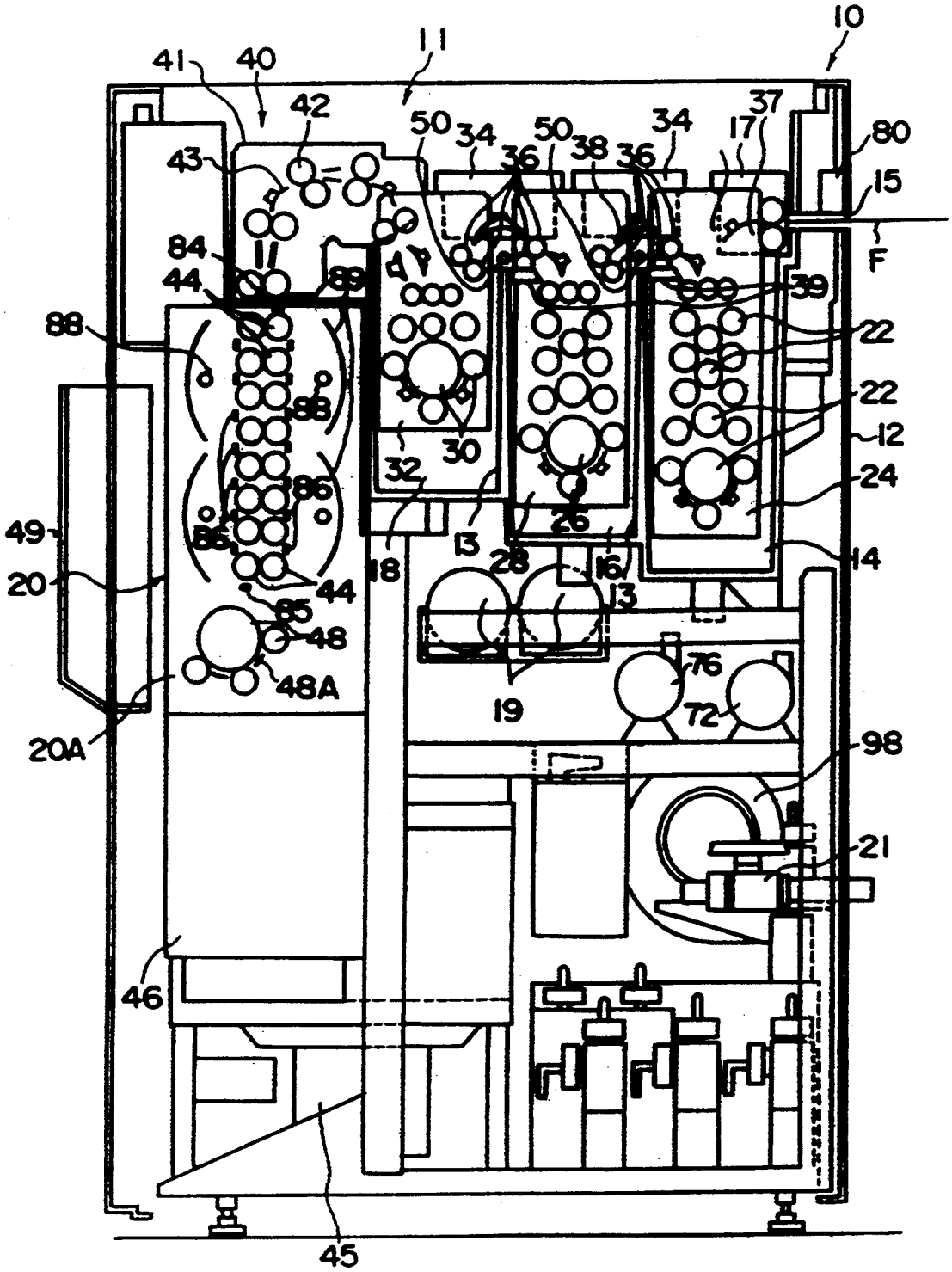
FIG. 1 is a schematic view showing of an automatic processor according to a first embodiment of the present invention.

FIG. 1 illustrates an automatic processor 10 according to the first embodiment. The automatic processor 10 is provided with a processing section 11 and a drying section 20 in a machine casing 12. The processing section 11 includes a developing tank 14, a fixing tank 16, and a washing tank 18 which are partitioned by partition walls 13 along the conveying direction of photosensitive material (hereafter referred to as film F).

In the automatic processor 10, an insertion detecting sensor 80 for detecting an insertion or absence thereof of film F is provided in a vicinity of an insertion opening 15. This detection of the insertion of the film F enables determination of the processing amount. For example, if a size of the film F to be used is constant, it is possible to recognize a processing area by only detecting the number of the film F. Further, if the sensor 80 can detect a width and a length of the film F, it is also possible to measure the area for each film F.

Developer is stored in the developing tank 14. Within the developing tank 14, a conveying rack 24 is provided having conveying rollers 22 which are driven by unillustrated driving means for conveying the film F. The conveying rack 24 is disposed so as to be immersed into the developer. Fixer is stored in the fixing tank 16. In the fixing tank 16, a conveying rack 28 is provided having conveying rollers 26 which are driven by unillustrated driving means for conveying the film F. The conveying rack 28 is disposed so as to be immersed into the fixer. Washing water is stored in the washing tank 18. Further, in the washing tank 18, a conveying rack 32 is provided having conveying rollers 30 which are driven by unillustrated driving means for conveying the film F, and the conveying rack 32 is disposed so as to be immersed into the washing water.

An exhaust fan 98 is disposed below the developing tank 14. The exhaust fan 98 ejects gas, steam or the like generated in the processing section 11 to the outside of the automatic processor 10.

Crossover racks 34 are respectively disposed above respective partition walls 13 provided between the developing tank 14 and the fixing tank 16, and between the fixing tank 16 and the washing tank 18. The crossover racks 34 are provided with pairs of conveying rollers 36 for conveying the film F from the processing tank on the upstream side in the conveying direction of the film F to the processing tank on the downstream side, and a guide plate 38 for guiding the film F.

Accordingly, the film F is inserted into the automatic processor 10 through the insertion opening 15, and is conveyed by the conveying rollers 22 in the developing tank 14 through the developer so as to be developed. The developed film F is ejected by the crossover rack 34 from the developing tank 14 and is fed to the fixing tank 16, where the film F is conveyed by the conveying rollers 26 through the fixer so as to be fixed. Thereafter, the fixed film F is fed to the washing tank 18 by the crossover rack 34 provided between the fixing tank 16 and the washing tank 18, where the film F is conveyed by the conveying rollers 30 through the washing water so as to be washed.

Figure 3:
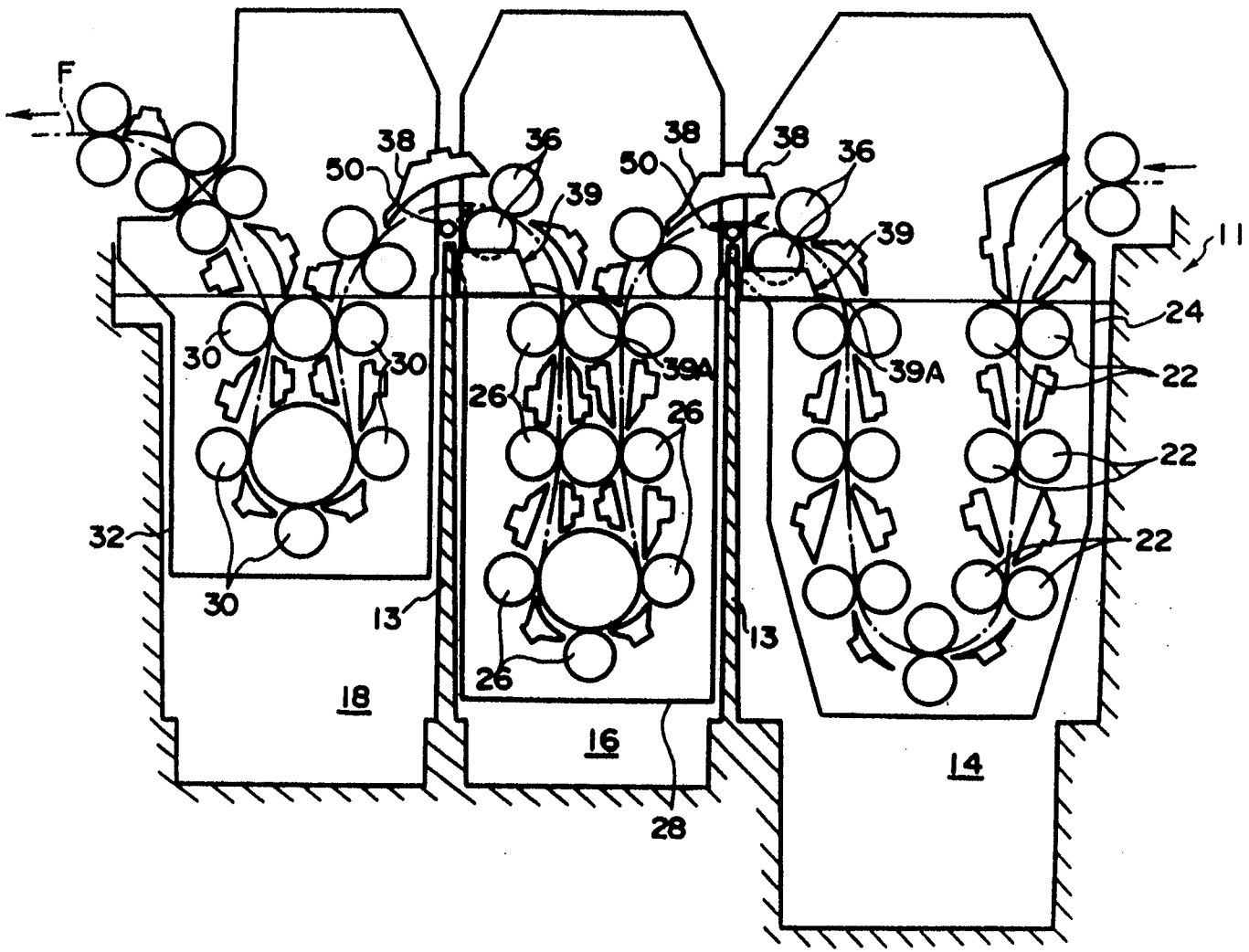
FIG. 3 is a front view showing conveying rollers and a structure in a vicinity thereof according to the first embodiment.
Figure 4:
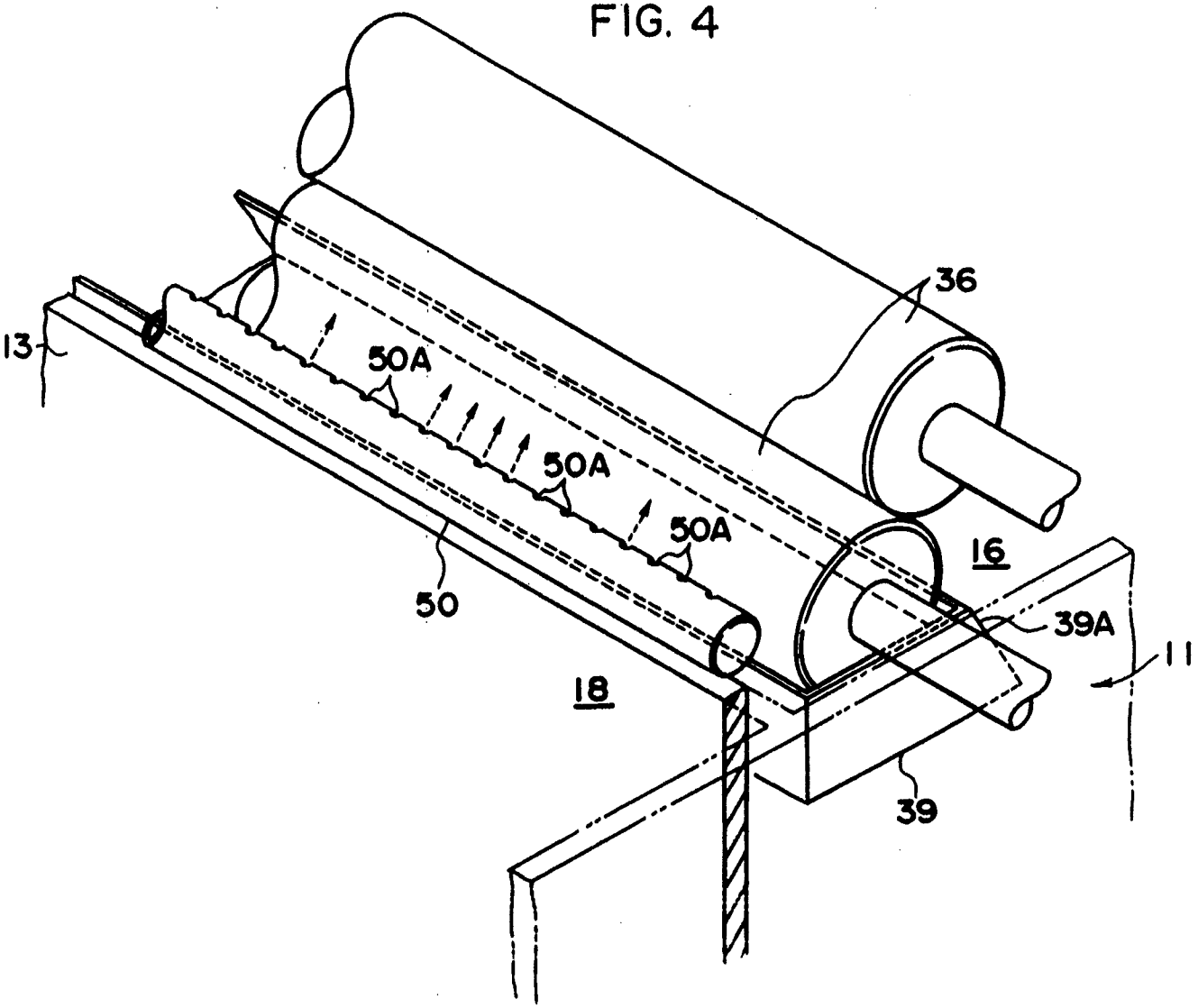
FIG. 4 is a perspective view showing the conveying rollers and the structure in the vicinity thereof according to the first embodiment.

As shown in FIGS. 3 and 4, rinse tanks 39 are respectively provided on the upstream side in a film conveying direction of the partition Wall 13 provided between the developing tank 14 and the fixing tank 16, and the partition wall 13 Provided between the fixing tank 16 and the washing tank 18. Washing water is stored in the rinse tank 39, and the roller of the pair of conveying rollers 36 on the lower side of the conveying route is immersed into the washing water in the rinse tank 39. A side surface of the rinse tank 39 on the upstream side in the film conveying direction is defined as an inclined surface 39A, and is disposed corresponding to the conveying route of the film F. That is, the inclined surface 39A serves as a guide surface for guiding the conveyed film F.

The washing water is ejected from discharge openings 50A (see FIG. 4) of spray pipes 50 disposed in vicinities of upper ends of the partition walls 13. The plurality of discharge openings 50A are aligned with each other, and are provided in peripheral surfaces of the spray pipes 50 in a longitudinal direction thereof. The discharge openings 50A are provided toward peripheral surfaces of the pair of conveying rollers 36 on the upstream side in the film conveying direction. Hence, the washing water ejected from the spray pipe 50 is sprayed onto the pair of conveying rollers 36 which are washed by the ejection.

Constituents of the processing solution are drawn from the previous process tank by adhering to the conveyed film F, and adhere to the pair of conveying rollers 36. Therefore, though the developer further adheres to the pair of conveying rollers 36, the washing water washes the constituents of the processing solution adhering to the film F so as to dilute the constituents of the developer. Further, the washing water keeps the pair of conveying rollers 36 continuously wet. The washing water prevents the crystals of the constituents contained in the developer and the fixer from adhering to or being deposited on the surface of the pair of conveying rollers 36 by washing off the constituents of the processing solution adhering to the pair of conveying rollers 36. In addition, it is desirable that the washing water be sprayed from the spray pipe 50 when the film F is being conveyed by the pair of conveying rollers 36, in order to avoid uneven development.

Figure 2:
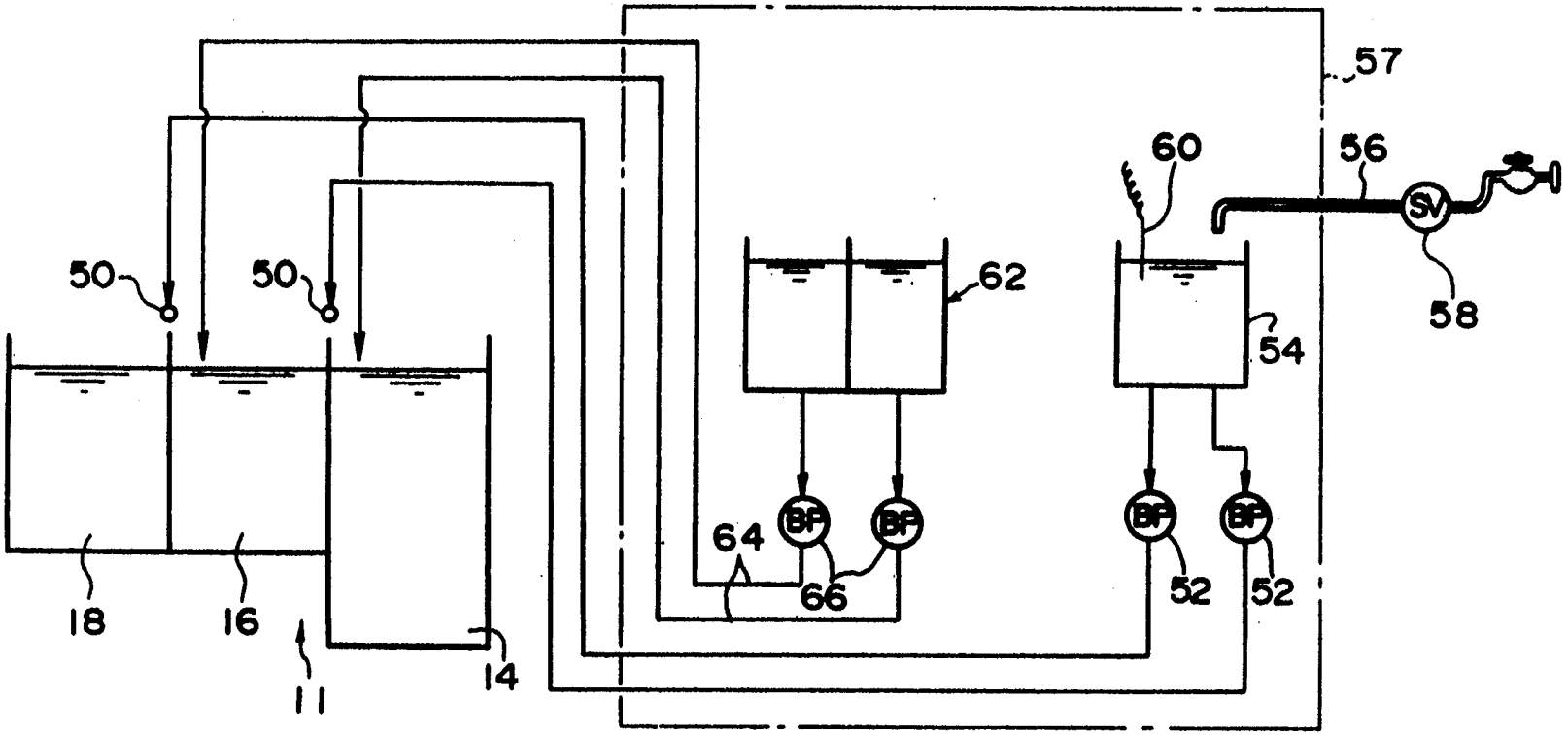
FIG. 2 is a system diagram showing a supply system of replenishing solution and diluting water according to the first embodiment.

As shown in FIG. 2, the spray pipes 50 are connected to discharge openings of bellows pumps (abbreviated BP) 52 for supplying diluting solution for stocking diluting solution of each processing solution. Suction openings of the bellows pumps 52 communicate with a bottom of a diluting water storage tank 54. Tap water is supplied through a water pipe 56 into the storage tank 54, and a predetermined amount of water is stored in the storage tank 54. A solenoid valve (abbreviated SV) 58 is interposed at an intermediate portion of the water pipe 56, and is opened and closed by an unillustrated control unit depending upon a signal output from a level sensor 60 which is disposed in the storage tank 54. Thus, the predetermined amount of water is continuously stored in the storage tank 54. The stock solutions of the developer and the fixer are respectively stored in stock tanks 62 which serve as replenishing solution supply means, and are supplied by actuation of the bellows pumps 66 to the developing tank 14 and the fixing tank 16 through piping 64, respectively.

The washing water discharged from the spray pipe 50 drops through the pair of conveying rollers 36 into the rinse tank 39 where the washing water is stored. The washing water stored in the rinse tank 39 overflows according to the discharge quantity from the spray pipe 50, and overflows into the processing tank on the upstream side, that is, into the developing tank 14 between the developing tank 14 and the fixing tank 16, or into the fixing tank 16 between the fixing tank 16 and the washing tank 18. This overflowing washing water drops into the developing tank 14 or the fixing tank 16, and is used as the diluting water for the replenishing solutions which are replenished into these tanks. Further, the level sensor 60 is preferably disposed in order to maintain a liquid level in the rinse tank 39. When the level is lowered less than a predetermined value, the washing water is supplied to the rinse tank 39 independent of the replenishment of the replenishing solution so as to raise the level at a position immediately before overflowing. It is thereby possible to reliably wash the rollers and dilute. The washing water may be directly supplied to the rinse tank 39 without the spray pipe 50.

The overflowing washing water flows into a vicinity of the place in the processing tank, to which the replenishing solution is supplied, so that the temperature and concentration of the processing solution in the processing tank can be uniform. Preferably, the fresh processing solution, which is made by replenishing the stock solution and the diluting water, does not directly flow into an overflow tank by separating the point from an overflowing section of the processing tank as far as possible.

As shown in FIG. 2, the replenisher is stocked in a stock tank 62 of a stock solution replenishing apparatus 57. One end of piping 64 is connected to a bottom portion of the stock tank 62. The other end of the piping 64 is positioned at an upper opening of the developing tank 14 or the fixing tank 16. A predetermined amount of replenishing solution is supplied to the developing tank 14 and the fixing tank 16 by the drive of bellows pumps 66 which are interposed at intermediate portions of the piping 64. On the other hand, the spray pipes 50 eject the diluting water according to a supply amount of the replenisher. Accordingly, the replenishing solution and the diluting water are mixed together in the developing tank 14 or the fixing tank 16, and the resultant solution is used as the replenisher.

The replenishing solution and the diluting water thereof may be supplied each time the photosensitive material is inserted, or each time when performing a predetermined amount of the processing. However, the replenishing solution and the diluting water are preferably supplied as frequently as possible, for example, during or immediately after the processing of the photosensitive material.

Unillustrated discharge pipes are provided for the respective bottoms of the developing tank 14, the fixing tank 16, and the washing tank 18, and discharge valves 21 are attached to the discharge pipes, respectively. It is possible to discharge the developer, the fixer and the washing water in the developing tank 14, the fixing tank 16 and the washing tank 18 by opening the discharge valves 21 as desired.

A squeeze rack 40 is disposed between the washing tank 18 and the drying section 20. The squeeze rack 40 is provided with conveying rollers 42 for conveying the film F which is conveyed from the washing tank 18 with the adhered washing water while squeezing the film F, and a guide 43 for guiding the film F.

As shown in FIG. 1, a plurality of conveying rollers 44 are provided along a vertical direction in a drying room 20A of the drying section 20 so as to form the conveying route for the film F. Further, infrared heaters 88 for heating the conveying rollers 44 are provided on the opposite side of the conveying route with respect to the conveying rollers 44.

The conveying rollers 44 are disposed so as to closely contact the film F along the transverse direction of the film F. The driving force of an unillustrated driving means is transmitted to the conveying rollers 44 so that the conveying rollers 44 are rotated to convey the film F while holding the film F.

Shielding plates 86 are positioned between adjacent conveying rollers 44 so as to shield heat radiated directly from the infrared heater 88 toward the film F.

On the other hand, surface temperature sensors 84, 85 for detecting the surface temperature of each conveying roller 44 are provided in a vicinity of the farthest upstream conveying roller 44, and in a vicinity of the farthest downstream conveying roller 44. Depending upon information detected by the surface temperature sensors 84, 85, the control unit controls the operation of the infrared heaters 88 so as to set the surface temperature of the conveying roller 44 to a temperature most suitable for drying of the film F.

As shown in FIG. 1, a drying fan 45 and a chamber 46 are attached under the drying section 20. The drying fan 45 sucks in air external to the automatic processor 10 so as to feed the air as drying wind to the chamber 46. The chamber 46 is provided with an unillustrated built-in heater so that the heater heats the drying wind fed through the drying fan 45 to supply the heated drying wind into the drying room 20A.

A conveying roller 48 and a guide 48A are disposed at a lower portion of the drying room 20A. The film F is conveyed by the conveying rollers 44 downward in a vertical direction, and is conveyed diagonally upward by the conveying roller 48 and tile guide 48A so as to be ejected out of the drying section 20. The automatic processor 10 is also provided with a receiving box 49 extending from an outer wall of the automatic processor 10. The film F ejected out of the drying section 20 is accommodated in the receiving box 49.

A description will now be given of the operation of the embodiment.

The film F inserted into the automatic processor 10 is fed to the developing tank 14, and is conveyed therethrough so as to be processed. The processed film F is fed into the fixing tank 16, and is conveyed therethrough so as to be fixed. The fixed film F is then fed to the washing tank 18, and conveyed therethrough so as to be washed.

The washed film F is conveyed to the squeeze rack 40, and conveyed therethrough with the film F being squeezed by the conveying rollers 42.

The film F which was squeezed in the squeeze rack 40 is fed into the drying room 20A of the drying section 20. In the drying room 20A, the film F is conveyed by the conveying rollers 44. The conveying rollers 44 are heated by the infrared heater 88, with the conveying rollers 44 sandwiching the film F therebetween. Consequently, the heat of the conveying rollers 44 can be transmitted to the film F so that the film F is heated and dried. The film F is also dried by the drying wind blown from the drying fan 45. Moisture evaporated from a surface of the film F is ejected from a vicinity of the conveying route. As a result, the film F can be efficiently dried.

In the drying section 20, the film F is held between the conveying rollers 44. The heat is transmitted to the film F by contacting the conveying rollers 44. Thus, heat can be efficiently transmitted to an emulsion layer of the film F. It is thereby possible to rapidly dry the film F. Further, since the shielding plate 86 prevents the direct radiation heat of the infrared heater 88 onto the film F, the film F is not burned even if jamming occurs during conveying the film F by the conveying rollers 44.

The infrared heaters 88 heat the conveying rollers 44. Hence, the surface temperature of the conveying rollers 44 may be detected by, for example, the surface temperature sensors 84, 85. The infrared heaters 88 may be actuated according to result of the detection. As a result, it is possible to efficiently actuate the infrared heaters 88. Further, in the drying section 20 of the automatic processor 10, the conveying rollers 44 are heated, and the film F is efficiently dried by the conveying rollers 44. Consequently, it is possible to reduce the number of the infrared heaters 88 as compared with a method of drying by directly radiating the heat of the infrared heater to the photosensitive material. Further, the saving of energy and cost can be effected.

An amount of the developer is decreased according to the processing amount of the film F. However, the liquid level of the developer is detected by an unillustrated level sensor provided in the developing tank 14. Developing replenisher is replenished into the developing tank 14 according to the information detected.

Similarly, an amount of the fixer is also decreased according to the processing amount of the film F. However, the liquid level of the fixer is detected by an unillustrated level sensor provided in the fixing tank 16. Fixing replenisher is replenished into the fixing tank 16 according to the information detected.

The pair of conveying rollers 36 are repeatedly kept in a wet state due to the processing solution (i.e., the developer or the fixer) which adheres to the film F, and in a dried condition when the automatic processor 10 stops. Consequently, constituents or contaminates in the processing solution are deposited on the pair of conveying rollers 36 when dried. The film may be damaged due to the constituents or the contaminates during conveyance. In order to avoid this, the pair of conveying rollers 36 are washed by the washing water so as to avoid the deposition of the contaminates or the like thereon.

Replenishment of the washing water is performed according to a replenishing period of the replenisher. That is, in the developing tank 14 or the fixing tank 16, bellows pumps 66 are actuated to supply the replenishing solution in the stock tank 62 to the developing tank 14 or the fixing tank 16 by a desired amount during the replenishing period. On the other hand, the bellows pumps 52 are actuated to feed diluting water from the storage tank 54 to the spray pipe 50 according to an amount of the supplied replenishing solution.

At this time, the discharge openings 50A of the spray pipe 50 are provided toward the pair of conveying rollers 36 disposed in the previous process so that the diluting water can be sprayed onto the pair of conveying rollers 36. That is, the diluting water is used as the washing water for washing the pair of conveying rollers 36.

The constituents of the processing solution adhere to the conveyed film F, and are drawn from the previous process (i.e., the process on the upstream side) so as to adhere to the pail of conveying rollers 36. The diluting water (i.e., the washing water) sprayed on the pair of conveying rollers 36 washes the processing solution off the pair of conveying rollers 36 while the film F is not being conveyed by the pair of conveying rollers 36. The diluting water used for washing drops into the processing tank in the previous process, or is stored in the rinse tank 39 under the pair of conveying rollers 36. Accordingly, it is possible to inhibit the degradation of the processing solution in the next process, and reduce the replenishing amount of the replenisher in order to avoid the contamination of the processing solution drawn in the previous process into the processing tank in the next process.

Most of the diluting water (the washing water) Sprayed onto the pair of conveying rollers 36 is guided to and stored in the rinse tank 39. Since the pair of conveying rollers 36 are partially immersed into the diluting water stored in the rinse tank 39, the pair of conveying rollers 36 are kept in a continuously wet state. Accordingly, it is possible to avoid adhesion or deposition of crystal having developer constituents and fixer constituents on the surfaces of the pair of conveying rollers 36 so as to enhance maintenance-free properties.

The diluting water in the rinse tank 39 overflows according to a discharged amount from the spray pipe 50, and drops into the developing tank 14 or the fixing tank 16. The dropping diluting water appropriately dilutes the developer or the fixer in the developing tank 14 or the fixing tank 16 into which the replenishing solution is supplied. Thus, predetermined replenisher can be supplied to the developing tank 14 or the fixing tank 16.

As set forth hereinbefore, in this embodiment, the diluting water for the replenishing solution, which is used to produce the replenisher, is not directly fed to the processing tanks. The diluting water is sprayed onto the pair of conveying rollers 36 by the spray pipes 50, and is supplied to the processing tanks after once being stored in the rinse tank 39. As a result, the diluting water for the replenishing solution can serve as both diluting water and washing water. Special piping for the washing water is not required, resulting in a simplified structure. Further, it is possible to reduce the consumption of water since the washing water is not disposed of in vain.

Though the diluting water (the washing water) ejected from the spray pipe 50 is once stored in the rinse tank 39 in this embodiment, the diluting water (the washing water) may drop directly into the developing tank 14 or the fixing tank 16 through the pair of conveying rollers 36.

Alternatively, the spray pipe 50 may be omitted. The diluting water (the washing water) may be directly supplied from the storage tank 54 to the rinse tank 39, or the diluting water may be drawn by rotation of the pair of conveying rollers 36 so as to wash the pair of conveying rollers 36.

Figure 5:
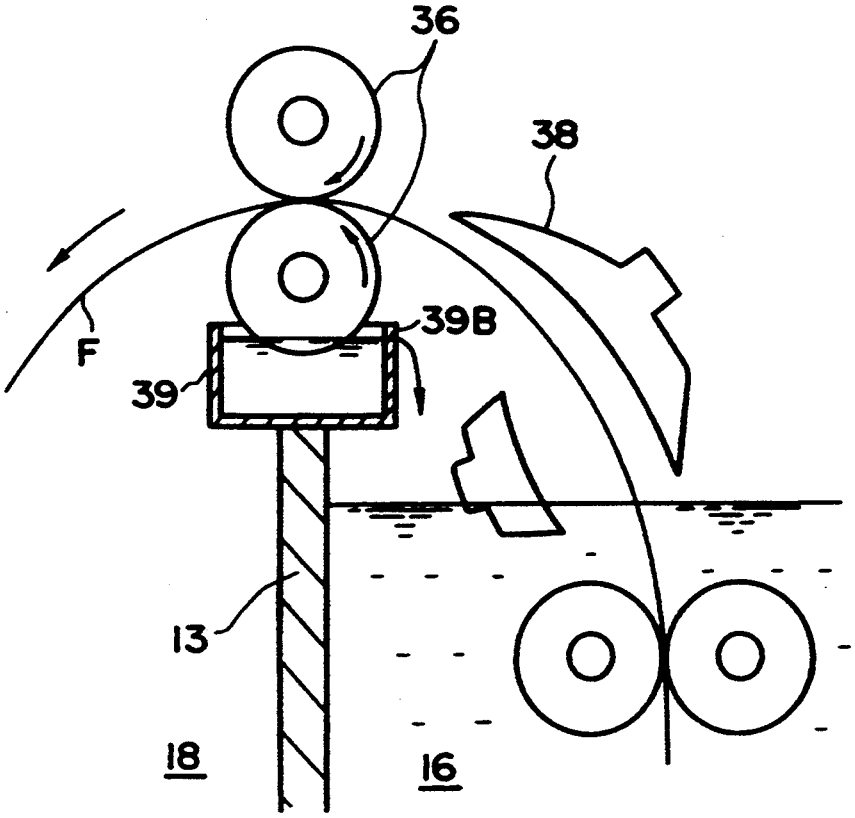
FIG. 5 is a schematic view in case the conveying rollers and a rinse tank are disposed above a partition wall.

In this case, the pair of conveying rollers 36 may be disposed above the partition wall 13, and the rinse tank 39 may be disposed above the partition wall 13 at a position such that the roller of the pail of conveying rollers 36 on the lower side of the conveying route is immersed into the diluting water (the washing water) as shown in FIG. 5. A notch portion 39B for overflow is provided in a side wall of the rinse tank 39 on the upstream side in the film conveying direction. The diluting water (the washing water) overflows into a tank on the upstream side, and is used as the diluting water for the processing solution. Alternatively, the pair of conveying rollers 36 may have a structure such that two pairs of conveying rollers 36 can be provided together.

A description will now be given of the operation of the second embodiment of the present invention. In the second embodiment, components identical with those in the first embodiment are designated by the same reference numerals, and the descriptions thereof are omitted.

Figure 6:
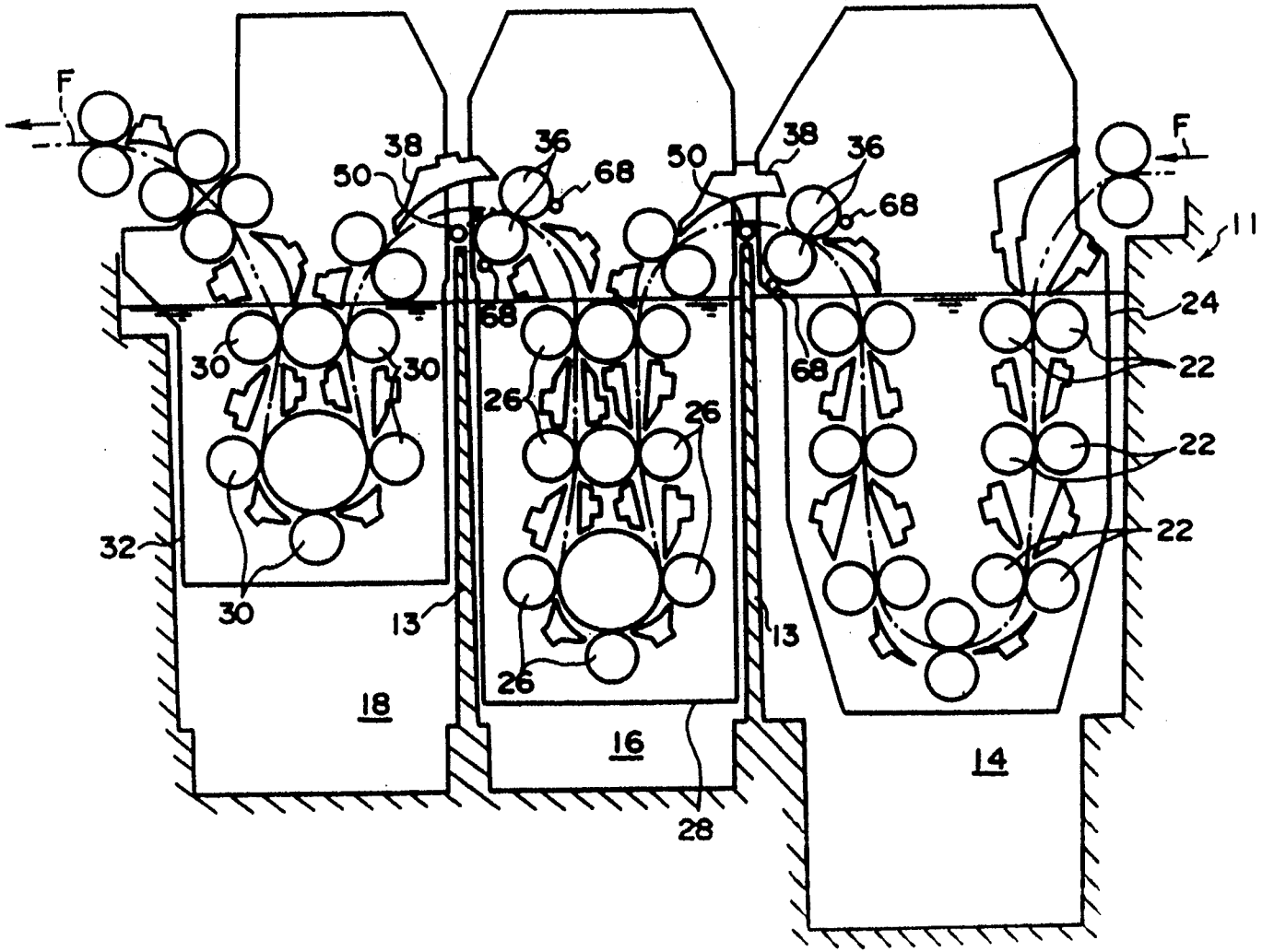
FIG. 6 is a front view showing the conveying rollers and the structure in the vicinity thereof according to a second embodiment.

As shown in FIG. 6, spray pipe 50 is disposed in a vicinity of the peripheral surfaces of the pair of conveying rollers 36 disposed in a fixing tank 16 on an electing side of a film F, so as to eject the diluting water (washing water) toward the pair of conveying rollers 36. However, a rinse tank is not provided as shown in the first embodiment, and the diluting water (the washing water) sprayed onto the pair of conveying rollers 36 drops directly into the fixing tank 16.

Squeezing rollers 68 having a small diameter are respectively disposed in a vicinity of the pairs of conveying rollers 36 in a state where the squeezing roller 68 and the conveying rollers 36 are in surface-to-surface contact. The squeezing roller 68 is rotated as the pair of conveying rollers 36 is rotated, and wipes off the processing solution adhering to the pair of conveying rollers 36. Thus, the squeezing roller 68 serves to wipe the processing solution drawn from the processing tank on the upstream side by adhering to the film F off the film F by the pair of conveying rollers 36, and serves to return the processing solution to the processing tank on the upstream side.

For example, when the film F is ejected from the fixing tank 16, a large amount of fixer adheres to the film F. Although the fixer can to some extent be wiped off by holding the film F between the pair of conveying rollers 36, the remaining fixer is again applied to the film F, and is carried to the washing tank. Further, the fixer is left adhered to the pair of conveying rollers 36 when the conveyance of the film F is terminated, that is, after a rear end of the film F has passed. A period for spraying the diluting water (the washing water) from the spray pipe 50 corresponds to the replenishing period of the replenisher. Accordingly, if a large amount of fixer adheres to the pair of conveying rollers 36, the fixer adhering to the pair of conveying rollers 36 may be removed to the next tank (i.e., the washing tank) by the film F. The squeezing roller 68 can wipe off the fixer adhering to the pair of conveying rollers 36. As a result, it is possible to reduce the amount of removed fixer.

In the second embodiment, though the squeezing roller 68 is employed as a squeezing member, it must be noted that distal ends of blades having flexibility or elastic properties may be disposed so as to contact the pair of conveying rollers 36, respectively.

Further, though the invention has been described by way of the fixing tank 16 as an example in the second embodiment, it must be noted that the invention may be applied to the developing tank 14 as well.

In addition, though the invention has been described with reference to a case where there is no rinse tank in the embodiment, the rinse tank may be employed instead of the spray pipe 50 so as to supply the diluting water from the rinse tank.

What is claimed is:

1. An automatic processing apparatus for processing photosensitive material by sequentially conveying and dipping said photosensitive material in a plurality of processing solution tanks which store processing solution, said automatic processing apparatus comprising:

a roller unit provided between two adjacent tanks of said plurality of processing solution tanks, for conveying said photosensitive material to a downstream processing solution tank of said two adjacent tanks;

replenishing solution supply means for supplying replenishing solution into an upstream processing solution tank of two adjacent tanks of said plurality of processing solution tanks; and diluting water supply means provided in the vicinity of said roller unit, for supplying diluting water into said upstream processing solution tank by supplying said diluting water directly to said roller unit for diluting said replenishing solution to a predetermined concentration, said roller unit being washed by said diluting water which is supplied to said upstream processing solution tank without being supplied into said downstream processing solution tank, thereby to avoid a mixing of processing solutions of said two adjacent tanks.

2. An automatic processing apparatus according to claim 1, wherein said diluting water is supplied to said upstream processing solution tank through said roller unit.

3. An automatic processing apparatus according to claim 2, wherein said replenishing solution means supplies said upstream processing solution tank with replenishing solution by an amount calculated based upon an area of said photosensitive material to be processed while said photosensitive material is being processed.

4. An automatic processing apparatus according to claim 2, wherein said diluting water supply means includes a spray pipe to wash said roller unit by ejecting said diluting water toward said roller unit while said roller apparatus is conveying said photosensitive material.

5. An automatic processing apparatus according to claim 1, wherein said roller unit comprises a pair of nip rollers for nipping and conveying said photosensitive material, and squeezing off processing solution adhering to said photosensitive material.

6. An automatic processing apparatus according to claim 4 further comprising:

a trough into which said roller unit is partially immersed, for storing said diluting water by receiving said diluting water ejected by said spray pipe through said roller unit, excess of said diluting water being overflowed from said trough into said upstream processing solution tank.

7. An automatic processing apparatus according to claim 6, wherein said replenishing solution supply means supplies replenishing solution to said upstream processing solution tank by an amount calculated based upon an area of said photosensitive material to be processed in synchronization with the ejection of diluting water from said spray pipe.

8. An automatic processing apparatus according to claim 4 further comprising:

a squeezing member disposed in contact with a part of said roller unit to squeeze said diluting water adhering to said roller unit.

9. An automatic processing apparatus according to claim 4, wherein said roller unit is disposed above said upstream processing solution tank.

10. An automatic processing apparatus according to claim 1 further comprising:

a trough into which a lower roller of said roller unit is dipped, for storing diluting water by receiving said diluting water supplied from said diluting water supply means, said diluting water stored in said trough being drawn by rotation of said lower roller of said roller unit from said trough so as to wash said roller unit, and said diluting water being guided from said trough to said upstream processing solution tank into which said replenishing solution is supplied after washing said roller unit.

11. An automatic processing apparatus according to claim 10, wherein diluting water supplied from said trough is guided in the vicinity of an opening of a replenishing solution supply pipe for guiding said replenishing solution from said replenishing solution supply means into said processing solution tank.

12. An automatic processing apparatus according to claim 11, wherein diluting water supplied from said diluting water supply means is supplied to said trough by an amount calculated based upon an area of said photosensitive material to be processed in synchronization with replenishment of replenishing solution into said upstream processing solution.

13. An automatic processing apparatus according to claim 1, wherein said roller unit comprises a pair of nip rollers, said diluting water supply means supplying diluting water to both of said nip rollers of said roller unit.

14. An automatic processing apparatus for processing photosensitive material by sequentially conveying and dipping said photosensitive material in a plurality of processing solution tanks storing processing solution, said automatic processing apparatus comprising:

a pair of rollers provided in the vicinity of an intermediate portion between two adjacent tanks of said plurality of processing solution tanks and above an upstream processing solution tank of said two adjacent tanks to convey said photosensitive material to a downstream processing solution tank of said two adjacent tanks, and squeeze off processing solution adhering to a photosensitive material surface;

replenishing solution supply means for supplying replenishing solution into said upstream processing solution tank of said plurality of processing solution tanks when said photosensitive material is being processed;

diluting water supply means provided in the vicinity of said pair of rollers for supplying diluting water into said processing solution tank through said pair of rollers for diluting said replenishing solution to a predetermined concentration, said diluting water supply means including a spray pipe for ejecting said diluting water toward said pair of rollers, and said pair of rollers being washed by said diluting water; and a trough into which one roller of said pair of rollers is partially dipped, for storing said diluting water by receiving said diluting water ejected from said spray pipe through said pair of rollers, and excess of said diluting water overflowing from said trough into said upstream processing solution tank.

15. An automatic processing apparatus according to claim 14, wherein said spray pipes are provided above partition walls provided between two adjacent tanks of said plurality of processing solution tanks.

16. An automatic processing apparatus according to claim 15, wherein said pair of rollers is provided on the upstream side of said respective partition walls.

17. An automatic processing apparatus according to claim 14, wherein said trough is provided on the upstream side of said partition wall and below said pair of rollers.

18. An automatic processing apparatus for processing photosensitive material by sequentially dipping said photosensitive material into a plurality of processing solution tanks storing processing solution while conveying said photosensitive material, said automatic processing apparatus comprising:

a pair of rollers provided between two adjacent tanks of said plurality of processing solution tanks so as to convey said photosensitive material from an upstream processing solution tank of said two adjacent tanks to a downstream processing solution tank of said two adjacent tanks;

replenishing solution supply means for supplying replenishing solution into said plurality of processing solution tanks, respectively;

diluting water supply means for supplying said upstream processing solution tank with diluting water for diluting said replenishing solution to a predetermined concentration in synchronization with supply of said replenishing solution by said replenishing solution supply means;

a diluting water trough provided below said pair of rollers to receive diluting water from said diluting water supply means, and store said diluting water such that a lower roller of said pair of rollers is partially immersed in said trough; and a notch portion provided in said trough so as to cause said stored diluting water to flow in an amount of overflow from said notch portion into said processing solution tank on the upstream side.

19. An automatic processing apparatus according to claim 18 further comprising:

a squeezing member disposed in contact with a part of said pair of rollers so as to squeeze off diluting water adhering to said pair of rollers.

20. An automatic processing apparatus according to claim 18, wherein said diluting water supply means directly supplies said diluting water trough with diluting water.

21. An automatic processing apparatus according to claim 19, wherein said squeezing member is one of a roller and a blade.

* * * * *